US007993184B2

(12) United States Patent
Thysell et al.

(10) Patent No.: US 7,993,184 B2
(45) Date of Patent: Aug. 9, 2011

(54) MACHINE FOR SCREEDING FLOOR SURFACES

(75) Inventors: Hakan Thysell, Soderkoping (SE); Karl Thysell, Soderkoping (SE); Urban Thysell, Ystad (SE)

(73) Assignee: HTC Sweden AB, Soderkoping (SE)

( * ) Notice: Subject to any disclaimer, the term of this patent is extended or adjusted under 35 U.S.C. 154(b) by 0 days.

(21) Appl. No.: 12/701,070

(22) Filed: Feb. 5, 2010

(65) Prior Publication Data

US 2010/0136891 A1 Jun. 3, 2010

Related U.S. Application Data

(63) Continuation of application No. 11/602,609, filed on Nov. 20, 2006, now Pat. No. 7,658,667, which is a continuation of application No. 10/450,723, filed as application No. PCT/SE02/00124 on Jan. 25, 2002, now Pat. No. 7,140,957.

(30) Foreign Application Priority Data

Feb. 6, 2001 (SE) ..... 01004167

(51) Int. Cl.
*B24B 7/18* (2006.01)

(52) U.S. Cl. ..... 451/350; 451/353
(58) Field of Classification Search ..... 451/350, 451/353, 357, 359
See application file for complete search history.

(56) References Cited

U.S. PATENT DOCUMENTS

| | | | | |
|---|---|---|---|---|
| 1,069,803 | A | 8/1913 | Nelson et al. | |
| 1,928,390 | A * | 9/1933 | Myers | 451/353 |
| 2,318,960 | A | 5/1943 | Okun | |
| 2,923,107 | A * | 2/1960 | Biasoni | 451/353 |
| 2,948,087 | A * | 8/1960 | Raymer | 451/271 |
| 3,169,262 | A | 2/1965 | Oliver L et al. | |
| 3,180,305 | A * | 4/1965 | Gower-Rempel | 440/12.56 |
| 3,452,486 | A | 7/1969 | Lombardo et al. | |
| 4,049,950 | A | 9/1977 | Byrne et al. | |
| 4,097,950 | A * | 7/1978 | Satterfield | 15/49.1 |
| 4,319,434 | A | 3/1982 | Brejcha | |
| 4,709,510 | A | 12/1987 | Giovanni et al. | |
| 4,862,548 | A | 9/1989 | Sergio | |
| 5,070,656 | A | 12/1991 | Brogden | |
| 5,637,032 | A * | 6/1997 | Thysell et al. | 451/259 |
| 6,238,277 | B1 | 5/2001 | Duncan et al. | |
| 6,244,933 | B1 * | 6/2001 | Morkvenas | 451/10 |
| 6,308,360 | B1 | 10/2001 | Stein | |

(Continued)

FOREIGN PATENT DOCUMENTS

DE 196 49 282 C1 6/1998

(Continued)

*Primary Examiner* — Maurina Rachuba

(74) *Attorney, Agent, or Firm* — Steven M. Jensen; Edwards Angell Palmer & Dodge LLP

(57) ABSTRACT

The invention relates to an arrangement in a mobile machine for screeding floor surfaces. This comprises a housing with a planet disk (3), which is rotatably supported in the bottom of the said housing and driven by a drive motor (1). The planet disk carries a number of rotatably supported screeding disks, distributed over the planet disk (3) and operatively connected to the drive motor (1). According to the invention the number of screeding disks is an even number up to a maximum of six. Viewed in the direction of rotation of the planet disk (3), half the number of screeding disks have a direction of rotation coinciding with the planet disk (3) and the remaining screeding disks an opposing direction of rotation.

8 Claims, 5 Drawing Sheets

U.S. PATENT DOCUMENTS

| | | | | |
|---|---|---|---|---|
| 6,331,138 | B1 * | 12/2001 | Witters et al. | 451/340 |
| 6,450,867 | B1 * | 9/2002 | Legatt | 451/350 |
| 6,494,773 | B1 * | 12/2002 | Marchini et al. | 451/353 |
| 6,540,596 | B1 | 4/2003 | Van Der Veen | |
| 6,616,517 | B2 * | 9/2003 | Palushi | 451/350 |
| 6,752,707 | B1 * | 6/2004 | Palushi | 451/350 |
| 6,783,447 | B2 | 8/2004 | Van Vliet et al. | |
| 7,140,957 | B2 * | 11/2006 | Thysell et al. | 451/350 |
| 7,658,667 | B2 * | 2/2010 | Thysell et al. | 451/350 |
| 2004/0023608 | A1 | 2/2004 | Van Vliet et al. | |

FOREIGN PATENT DOCUMENTS

| | | | |
|---|---|---|---|
| EP | 0 700 327 | A1 | 3/1996 |
| EP | 0 984 845 | A1 | 3/2000 |
| FR | 1108781 | | 9/1955 |
| FR | 2073627 | | 9/1971 |
| WO | 00/01291 | A1 | 1/2000 |
| WO | 01/87540 | A1 | 11/2001 |

* cited by examiner

MACHINE FOR SCREEDING FLOOR SURFACES

CROSS-REFERENCE TO RELATED APPLICATION(S)

This application is a continuation of application U.S. Ser. No. 11/602,609 filed Nov. 20, 2006, now U.S. Pat. No. 7,658,667, which is a continuation of U.S. Ser. No. 10/450,723 filed Nov. 21, 2003, now U.S. Pat. No. 7,140,957, which is a National Phase entry of International Application No. PCT/SE02/00124 having an International Filing Date of Jan. 25, 2002, which claims priority to Swedish Application No. 0100416-7, filed on Feb. 6, 2001, all of which are incorporated by reference herein in their entireties.

FIELD OF THE INVENTION

The present invention relates to an arrangement in a mobile machine for screeding floor surfaces.

BACKGROUND OF THE INVENTION

Reference is made to U.S. Pat. No. 5,637,032 A, U.S. Pat. No. 1,069,803 A, U.S. Pat. No. 4,097,950 A, FR 2073627 A5, FR 1108781 A as examples of the prior art.

Screeding machines of the aforementioned type function inherently well, but as the material in the screeding disks used to machine the floor surfaces is progressively developed, thereby enabling it to remove more floor material per unit time than before, there is a desire for more available power for machining of the floor material.

BRIEF SUMMARY OF THE INVENTION

The object of the present invention is to produce an arrangement in a screeding machine of the type referred to in the introductory part, which has an improved removal capability compared to known screeding machines. This is achieved in that the arrangement has the characteristic features specified in the characterising part of claims 1 and 3.

The arrangement according to the invention furthermore has one or more of the characteristic features specified in the subordinate claims.

The invention moreover affords the following advantages:

The screeding machine designed according to the invention has an improved balance and reduced lateral rotation, which especially in the case of a manually operated machine makes it easier to hold and control. More even screeding is achieved; with known machines it is easy to end up with a machining mark having a plate-shaped cross-section, which means that it is necessary to screed with a relatively large overlap, in order to obtain a plane finish.

BRIEF DESCRIPTION OF THE SEVERAL VIEWS OF THE DRAWINGS

The invention will be explained in more detail below with reference to the drawing attached, in which FIG. 1*a*, in an oblique, perspective view from beneath, shows by way of example a screeding unit in a screeding machine according to the invention, having a drive motor and a dished planet disk, which accommodates a belt transmission.

DETAILED DESCRIPTION OF THE INVENTION

Figure 1A:
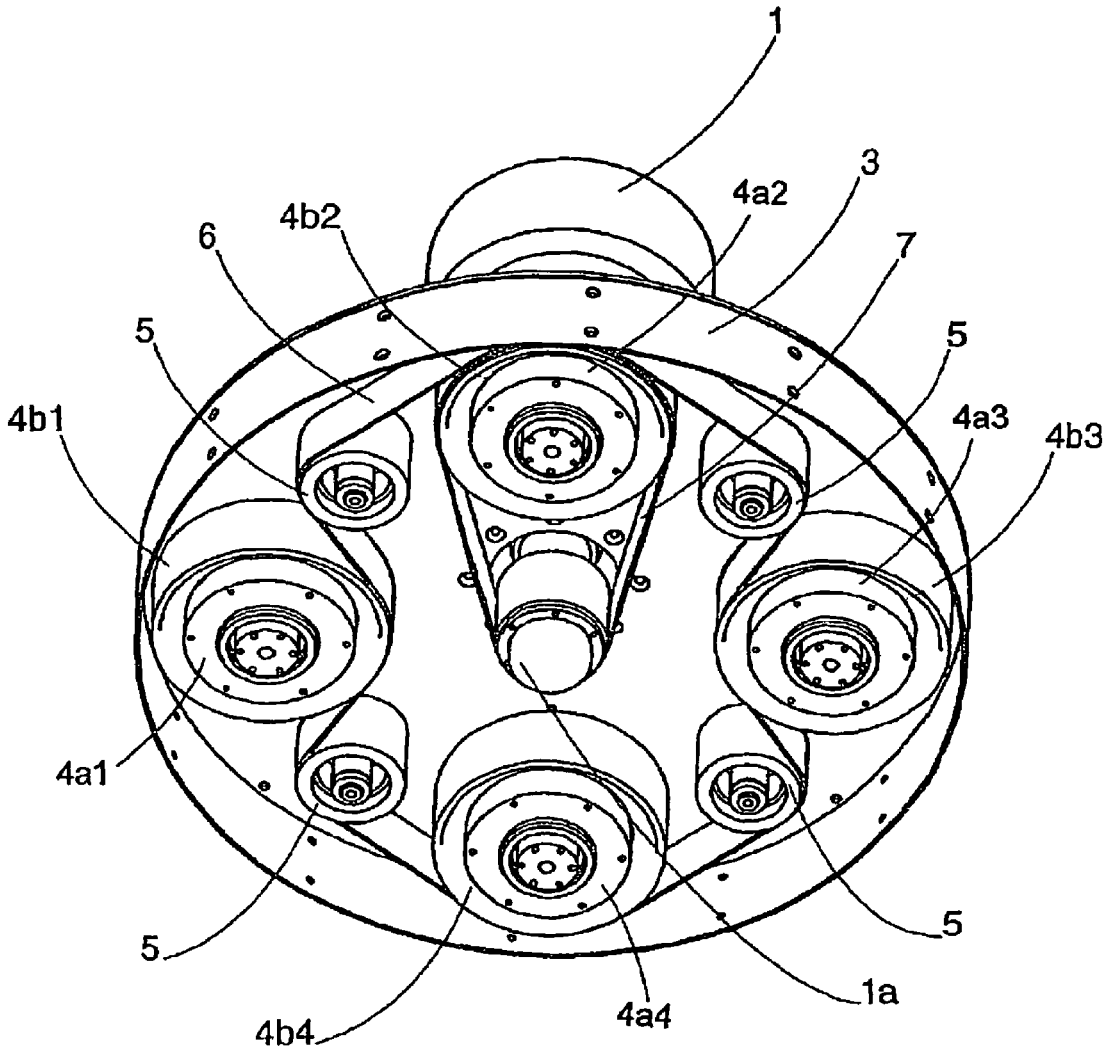
FIG. 1*b* shows the drive motor and the planet disk in FIG. 1*a* in an oblique perspective view from above.
FIG. 1*c* shows essentially the same view as FIG. 1*a*, but the planet disk and the belt transmission are covered by a cover plate with openings for the machine's screeding disks.
Figure 1B:
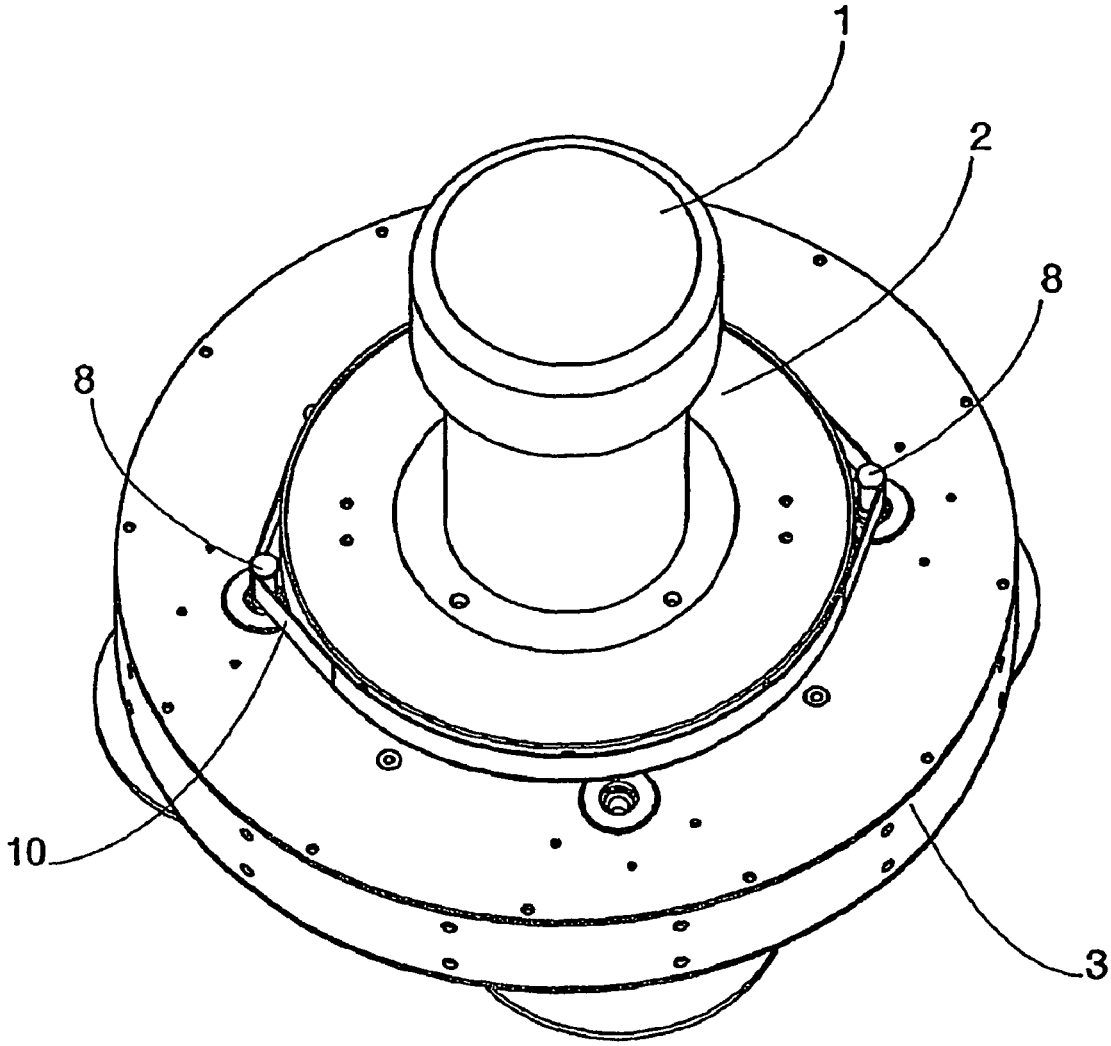

In FIGS. 1*a*, 1*b*, 1 denotes a drive motor mounted on a motor plate 2. The motor plate 2 is designed to be fitted in a screeding machine casing, not shown further, by means of a screw nut connection.

Figure 1C:
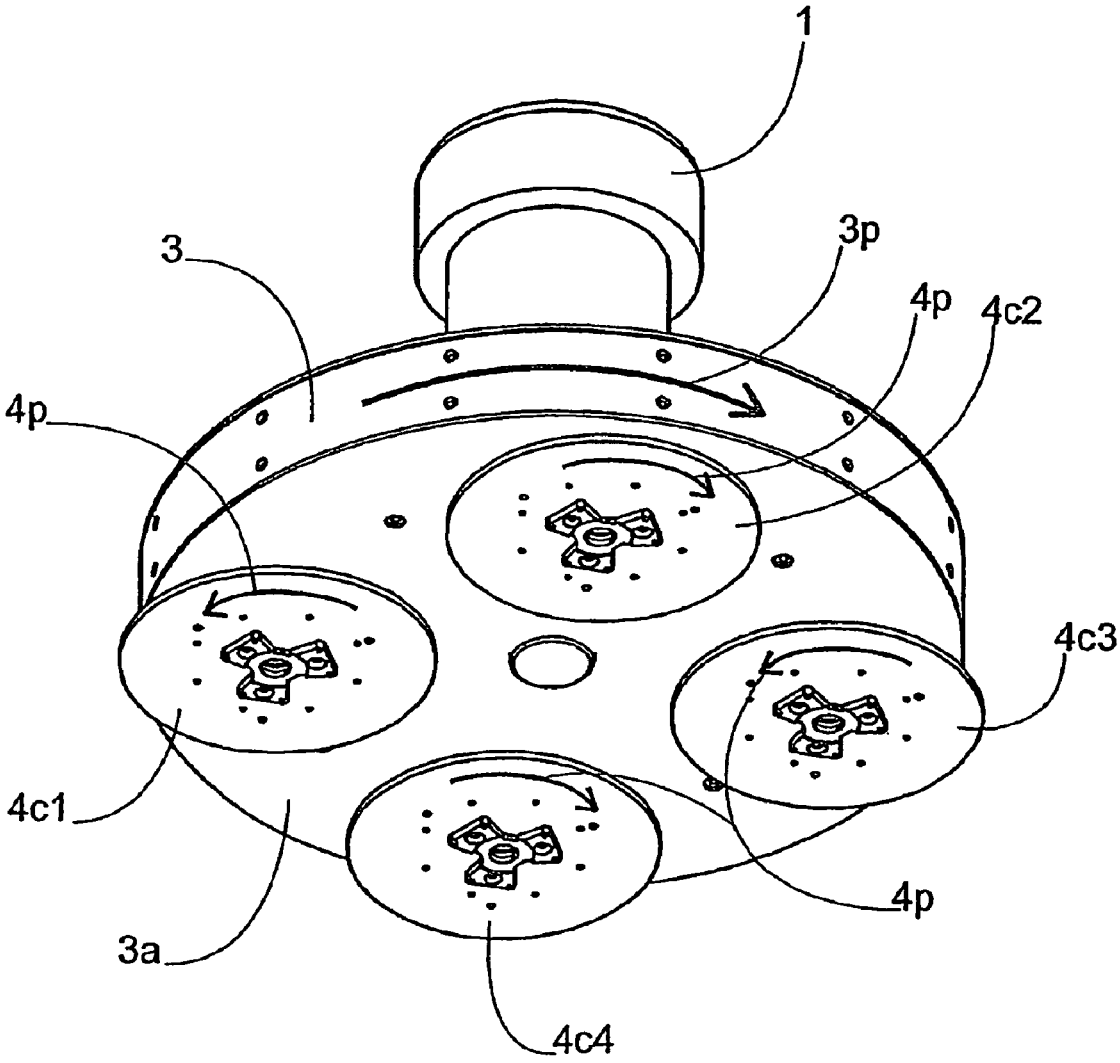

3 denotes a planet disk, which is supported so that it can rotate in relation to the motor plate 2 and is shaped like a dish open at the bottom. When the screeding unit is ready for use the dish is covered by a protective plate having openings for the screeding disks. The dish with the protective plate forms a protected space for the drive mechanism, as will be explained below. This space accommodates four symmetrically located holders 4*a*1 4*a*4 for screeding disks 4*c*1 4*c*4, the holders being supported so that they can rotate, in the planet disk 3. For the sake of clarity, the screeding disks have been omitted from FIG. 1*a* but are shown in FIG. 1*c*, in which the directions of rotation, according to the invention, of the screeding disks 4*c*1 4*c*4 and the planet disk 3 are also illustrated by arrows 3*p* and 4*p* respectively. 3*a* denotes a plate having openings for the screeding disks 4*c*1 4*c*4, designed to protect the belt transmissions in the dished planet disk 3. A belt sheave 4*b*1 4*b*4 is connected to each holder 4*a*1 4*a*4 for driving each screeding disk in the manner characteristic of the invention. A belt 6 runs over the belt sheaves 4*b*1 4*b*4 and over deflection sheaves 5 arranged between them. A belt sheave 1*a* arranged on the shaft of the motor 1 is designed to drive the belt sheave 4*b*2 by way of a belt 7, thereby causing the other belt sheaves to rotate. Since the belt 6 runs over that section of the circumference situated nearest to the centre of the planet disk 3 in respect of the belt sheaves 4*b*1 and 4*b*3 and over the section of the circumference situated furthest away from the said centre in respect of the belt sheaves 4*b*2 and 4*b*4, the belt sheaves 4*b*1, 4*b*3 assume opposing directions of rotation relative to the belt sheaves 4*b*2, 4*b*4, thereby providing the characteristic feature of the present invention, namely that adjacent screeding disks have opposite directions of rotation.

Figure 2:
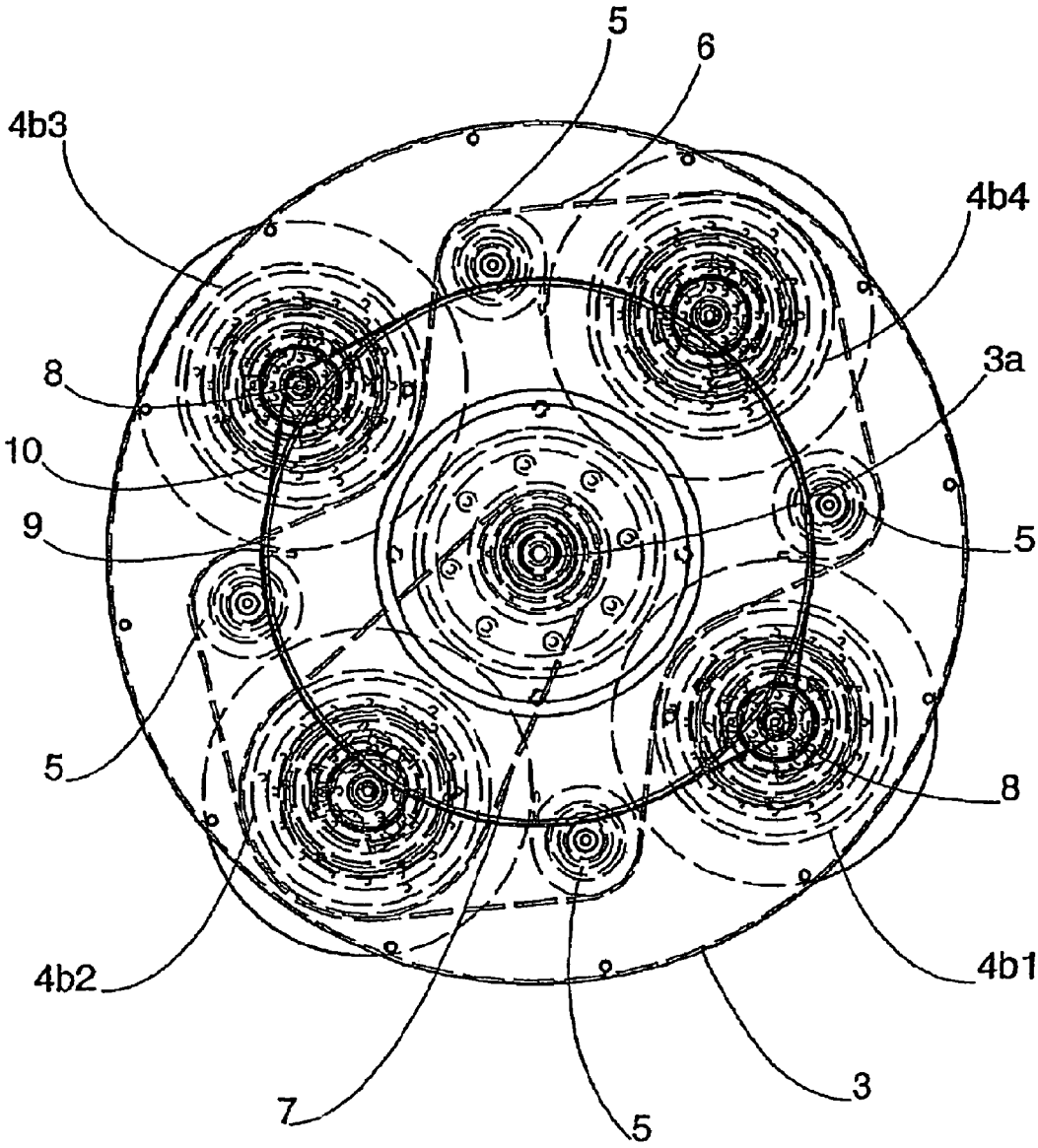
FIG. 2, by way of an example, shows a plan view of a system of belts for driving the screeding machine planet disk and screeding disks of the type used in the embodiment according to FIGS. 1*a*, 1*b*.
Figure 3:
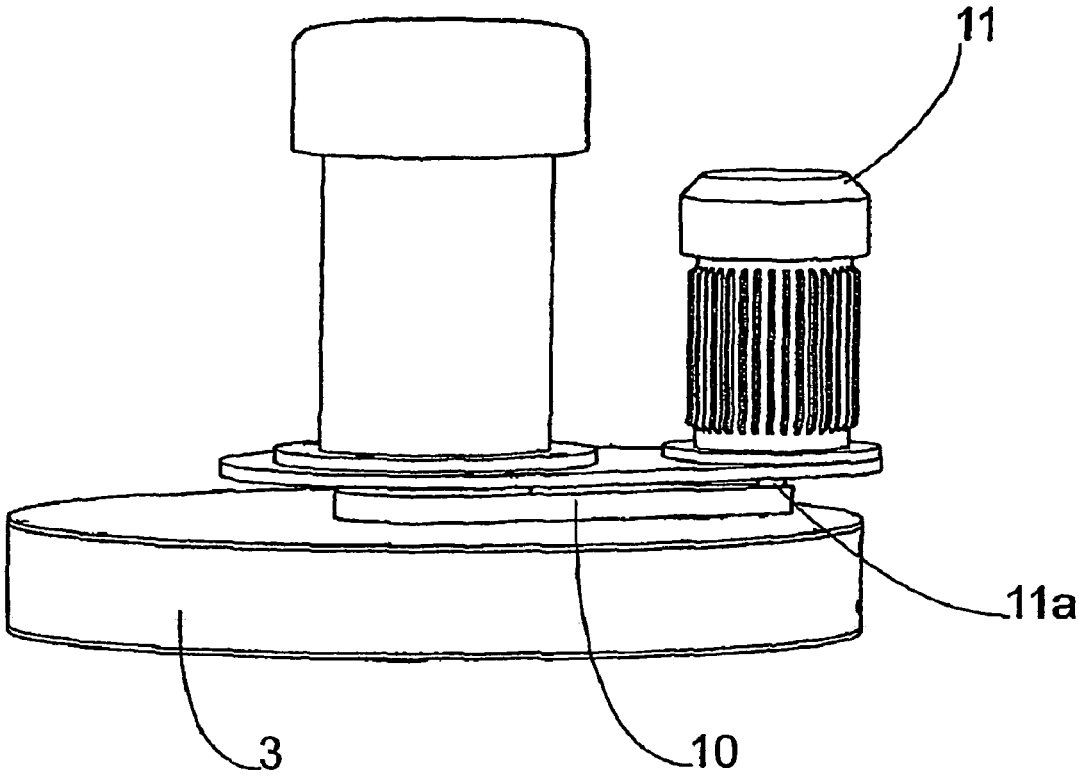
FIG. 3 in a side view illustrates an embodiment of a screeding unit according to the invention, in which the screeding unit planet disk is driven by a separate drive motor.

From FIG. 1*b* it can be seen that shafts of the belt sheaves 4*b*1, 4*b*3 protrude from the dished planet disk 3 and form belt sheaves 8. 9 denotes a belt sheave fixed to the motor plate 2. A belt 10, by means of which the rotation of the motor 1 is transmitted to the planet disk 3 by way of the belt sheave 1*a*, the belt 7, the belt sheave 4*a*2, the belt 6 and the belt sheaves 4*b*1, 4*b*3, runs over the belt sheaves 8 and 9. It may be noted in this connection that the planet sheave 3 has the same direction of rotation as the screeding disks 4*c*2, 4*c*4. From this it follows that these screeding disks in an area furthest away from the centre of the planet disk 3 have a higher peripheral speed in relation to a surface that is to be screeded than do the screeding disks 4*c*1, 4*c*3 in the same area. If so required, this can, as the person skilled in the art will appreciate, be compensated for by giving the belt sheaves 4*b*1, 4*b*3 and 4*b*2, 4*b*4 correspondingly different diameters. For the sake of clarity all belts and belt sheaves are drawn in FIG. 2.

The person skilled in the art will also appreciate that some or all of the belt transmissions may be replaced by gear transmissions or transmissions having a frictional engagement.

It will also be appreciated that, without departing from the idea of the invention, six screeding disks supported by holders may be arranged on the planet wheel 3, each holder being connected to a belt sheave. A belt runs over the belt sheaves and over intermediate deflection sheaves in the manner already explained, which means that adjacent screeding disks have opposite directions of rotation. At the same time the planet disk carrying the screeding disks is driven in the same way as explained earlier. In this embodiment also, the belt transmissions can be replaced wholly or in part by gear transmissions or transmissions having a frictional engagement.

In a particular embodiment of the arrangement according to the invention, the planet disk 3 is driven by its own motor 11. The belt 10, which in the embodiment according to FIGS. 1*a*, 1*b* runs over belt sheaves 8, then runs instead over the belt sheave 11*a* of the motor 11. Separate driving of the planet disk 3 affords two advantages: firstly it is possibly to freely select the direction of rotation of the planet disk 3 and secondly the speed of rotation can be selected irrespective of the speed of the screeding disks, in order obtain the optimum screeding result. A gear transmission can obviously also be used in this embodiment instead of the belt transmission.

Although the invention above has been primarily illustrated and explained in connection with a screeding unit for a manually operated screeding machine, it will be obvious that the screeding unit according to the invention affords the same advantages when it is fitted to a powered screeding machine. It is also advantageous here that lateral forces occurring are minimised and that the effective screeding profile of the screeding unit permits screeding with little overlap.

What is claimed is:

1. A machine for screeding floor surfaces, comprising:

a drive motor;

a motor plate;

a planet disk configured to rotate relative to the motor plate;

a number of rotatably supported screeding disks distributed over the planet disk, the number of screeding disks being four or six, half the number of screeding disks having a direction of rotation coinciding with the planet disk and the remaining screeding disks having an opposing direction of rotation; and first and second belt sheaves operatively connected to a respective one of the screeding disks having the same direction of rotation, a third belt sheave fixed to the motor plate, and a belt arranged between and in contact with the first, second, and third belt sheaves.

2. The machine of claim 1, wherein the drive motor is fixedly connected to the motor plate.

3. The machine of claim 1, wherein the drive motor drives at least a shaft belt sheave.

4. The machine of claim 3, further comprising a second belt running over the shaft belt sheave, and operatively connected to at least the first and second belt sheaves.

5. The machine of claim 1, further comprising a second drive motor for driving solely the planet disk.

6. The machine of claim 1, wherein the screeding disks define one screeding plane.

7. The machine of claim 1, further comprising deflection sheaves arranged between the belt sheaves.

8. The machine of claim 7, further comprising a third belt that runs over the belt sheaves and the deflection sheaves.

* * * * *